United States Patent [19]

Castegnier

[11] Patent Number: 4,555,320

[45] Date of Patent: Nov. 26, 1985

[54] IMAGE REPRODUCTION BY IN PLANE ELECTRO-COAGULATION OF A COLLOID

[75] Inventor: Adrien Castegnier, Outremont, Canada

[73] Assignee: Elcorsy Inc., Saint-Laurent, Canada

[21] Appl. No.: 614,020

[22] Filed: May 25, 1984

[51] Int. Cl.[4] ..... C25D 13/04; C25D 13/06; C25D 13/12; C25D 13/18

[52] U.S. Cl. ..... 204/180.9; 204/2; 204/180.2; 204/181.6; 204/299 EC

[58] Field of Search ..... 204/181 R, 181 F, 181 PE, 204/180 R, 2, 299 R, 299 PE, 300 R, 299 EC

[56] References Cited

U.S. PATENT DOCUMENTS

| | | | |
|---|---|---|---|
| 3,752,746 | 8/1973 | Castegnier | 204/2 |
| 3,892,645 | 7/1975 | Castegnier | 204/180 |
| 4,330,788 | 5/1982 | Hinz et al. | 204/299 R |

OTHER PUBLICATIONS

Irmischer, D. W., et al., "Print Head for Electrochromic Printing", *IBM Technical Disclosure Bulletin,* vol. 22, No. 3, pp. 1256–1257, (1979).

*Primary Examiner*—Andrew H. Metz
*Assistant Examiner*—B. J. Boggs Jr.
*Attorney, Agent, or Firm*—Schwartz, Jeffery, Schwaab, Mack, Blumenthal & Evans

[57] ABSTRACT

A method and system for high speed image reproduction by electro-coagulation of an electrolytically coagulable colloid. A plurality of negative and positive electrolytically inert electrodes which are electrically insulated from one another are arranged to define a matrix of dot-forming elements, the negative and positive electrodes of each matrix element having planar active surfaces extending in a substantially common plane and in close proximity to one another. A layer of substantially liquid colloidal dispersion is applied over the electrode active surfaces of the matrix elements, the colloidal dispersion containing an electrolytically coagulable colloid, a liquid dispersing medium and a soluble electrolyte, and having a substantially uniform temperature throughout the layer. The negative and positive electrodes of selected ones of the matrix elements are electrically energized to cause selective coagulation and adherence of the colloid onto the positive electrode active surfaces of the selected matrix elements and to thereby form a series of corresponding dots representative of a desired image, and any remaining non-coagulated colloid is thereafter removed.

23 Claims, 6 Drawing Figures

IMAGE REPRODUCTION BY IN PLANE ELECTRO-COAGULATION OF A COLLOID

BACKGROUND OF THE INVENTION

The present invention relates to improvements in high speed image reproduction. More particularly, the invention is concerned with an improved method and system for reproducing an image by the electro-coagulation of an electrolytically coagulable colloid.

Applicant has already described in his U.S. Pat. No. 3,892,645 of July 1, 1975 an electric printing method and system in which a thin layer of a liquid composition containing a colloid such as gelatin or albumin, water and an electrolyte is interposed between at least one pair of opposite negative and positive electrodes spaced from one another to define a gap which is filled by the liquid composition. In one embodiment, there is a plurality of electrically-insulated juxtaposed negative electrodes and selected ones thereof are electrically energized to pass electric pulses through the layer at selected points to cause point by point selective coagulation and adherence of the colloid on the positive electrode directly opposite each energized negative electrode, thereby forming imprints.

It is very important that the gap between the negative and positive electrodes be uniform throughout the active surfaces of the electrodes since otherwise there will be a variation in the thickness of the layer and thus a corresponding variation of the electrical resistance thereof at different locations between the electrodes, which will result in a non-uniform image reproduction as the thickness of the coagulated colloid is proportional to the amount of current passed through the layer. Since this gap is of the order of $50\mu$, its uniformity is of course very difficult to control. Moreover, where the negative electrodes are energized more than once in the reproduction of an image, these become polarized resulting in a gas generation and accumulation at the negative electrodes, which adversely affect the image reproduction.

SUMMARY OF THE INVENTION

It is therefore an object of the present invention to overcome the aforementioned drawbacks and to provide a method and system for reproducing an image by the electro-coagulation of a colloid, which do not necessitate a critical control of the electrode gap nor cause electrode polarization which may hinder the image reproduction.

According to one aspect of the invention, there is provided a method of reproducing an image by electro-coagulation of an electrolytically coagulable colloid, which comprises the steps of:

(a) providing a plurality of negative and positive electrolytically inert electrodes electrically insulated from one another and arranged to define a matrix of dot-forming elements, the negative and positive electrodes of each matrix element having respective planar active surfaces with the negative electrode active surface extending in substantially the same plane as the positive electrode active surface and in close proximity thereto;

(b) applying a layer of a substantially liquid colloidal dispersion over the negative and positive electrode active surfaces of the matrix elements, whereby the positive and negative electrode active surfaces are disposed on the same side of the layer of colloidal dispersion the colloidal dispersion containing an electrolytically coagulable colloid, a liquid dispersing medium and a soluble electrolyte and having a substantially uniform temperature throughout the layer;

(c) generating an electrical field between the negative and positive electrodes of selected ones of the matrix elements, the electrical field extending substanially parallel to the planar active surfaces of the negative and positive electrodes, whereby to cause selective coagulation and adherence of the colloid onto the positive electrode active surfaces of the selected matrix elements, by forming a series of corresponding dots representative of a desired image; and (d) removing any remaining non-coagulated colloid.

The invention also provides, in a further aspect thereof, a system for reproducing an image by electro-coagulation of an electrolytically coagulable colloid, which comprises:

a plurality of negative and positive electrolytically inert electrodes electrically insulated from one another and arranged to define a matrix of dot-forming elements, the negative and positive electrodes of each matrix element having respective planar active surfaces with the negative electrode active surface extending in substantially the same plane as the positive electrode active surface and in close proximity thereto, the electrode active surfaces being adapted to receive thereover a layer of a substantially liquid colloidal dispersion containing an electrolytically coagulable colloid, a liquid dispersing medium and a soluble electrolyte and having a substantially uniform temperature throughout the layer; and means for electrically energizing the negative and positive electrodes of selected ones of the matrix elements to cause selective coagulation and adherence of the colloid onto the positive electrode active surfaces of the selected matrix elements and to thereby form a series of corresponding dots representative of a desired image.

Thus, according to the invention, since the active surfaces of the negative and positive electrodes are no longer disposed opposite one another in different planes, but rather extend in substantially the same plane, there is no longer any necessity of having to control in precise manner the thickness of the layer of colloidal dispersion applied. Also, since the electrodes of each dot-forming matrix element are energized only once in the reproduction of an image, there are barely any electrode polarization and resulting gas accumulation that may hinder the image reproduction.

In a preferred embodiment of the invention, the negative and positive electrodes of the matrix comprise respectively first and second sets of mutually electrically-insulated band-like electrode members disposed in parallel side-by-side relation, the negative electrode members of the first set extending transversely of the positive electrode members of the second set and being formed with a plurality of protruding conductive elements which are spaced along the length thereof and each have a planar active end surface. The protruding elements of each negative electrode member extend through corresponding bores formed in the positive electrode members to terminate flush therewith such that the planar active end surface of each protruding element and a planar active surface portion of each positive electrode member adjacent each bore extend in a substantially common plane whereby to define the aforesaid matrix elements. Thus, the electrical energizing of the negative and positive electrodes of selected matrix elements may be effected by sequentially energizing the electrode members of one set and concurrently energizing selected ones of the electrode members of the other set. Preferably, the positive electrode members are sequentially energized while selected ones of the negative electrode members are concurrently energized.

The concurrent selective energizing of the electrode members of the other set is advantageously effected by sweeping such electrode members and transmitting electrical pulses to selected ones thereof during sweeping. These electrical pulses can be varied either in voltage or time from one electrode member to another so as to correspondingly vary the amount of coagulated colloid adhered onto the positive electrode active surfaces of the selected matrix elements. This enables one to form dots of varying intensities and thus to reproduce the half-tones of an image.

The colloid generally used is a linear colloid of high molecular weight, that is, one having a molecular weight comprised between about 10,000 and about 1,000,000, preferably between 100,000 and 500,000. Examples of suitable colloids include animal proteins such as albumin, gelatin and casein, vegetable proteins such as agar and synthetic copolymers such as polyacrylic acid, polyacrylamide, polyvinyl alcohol and derivatives thereof. Water is preferably used as the medium for dispersing the colloid to provide the desired colloidal dispersion.

The colloidal dispersion also contains a soluble electrolyte which enables the water to have a greater conductivity; the water is believed to migrate under direct current towards the negative electrode and thereby cause the colloidal dispersion to dry out, resulting in coagulation of the colloid and adherence thereof onto the positive electrode. Examples of suitable electrolytes include chlorides and sulfates, such as potassium chloride, sodium chloride, calcium chloride, nickel chloride, lithium chloride, ammonium chloride, and manganese sulfate. Since the speed of electro-coagulation is affected by temperature, the layer of colloidal dispersion must be maintained at a substantially constant temperature, for instance by using a thermmostatic water jacket, in order to ensure a uniform image reproduction.

After coagulation of the colloid, any remaining non-coagulated colloid is removed by any suitable means, such as by washing off, airjet or wiping to fully uncover the coagulated colloid.

The applications of the invention are basically the same as those mentioned in Applicant's U.S. Pat. No. 3,892,645. For example, the coagulated colloid can be colored with a hydrotypic pigment which is absorbed thereby and the colored coagulated colloid may then be transferred onto an end-use support, such as paper. The coagulated colloid can also be set or hardened chemically or by irradiation so as to be used for off-set lithographic printing. Moreover, it is possible to produce several differently colored images of coagulated colloid which can be transferred onto an end-use support is superimposed relation to provide a polychromatic image.

BRIEF DESCRIPTION OF THE DRAWINGS

Further features and advantages of the invention will become more readily apparent from the following description of preferred embodiments thereof as illustrated by way of examples in the accompanying drawings, in which.

Figure 1:
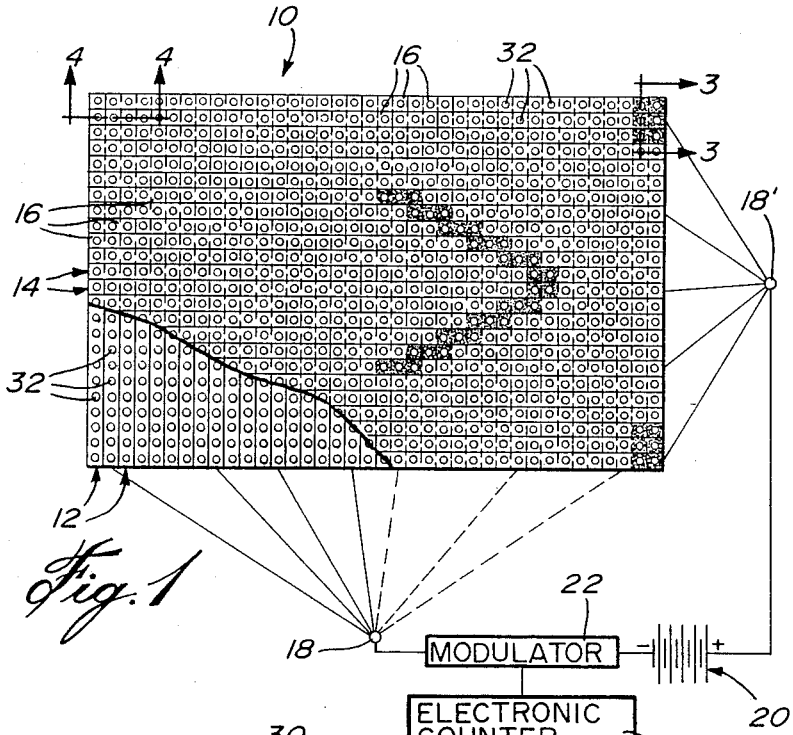
FIG. 1 schematically illustrates an image reproduction system according to the invention, the dot matrix printer of which is shown partially cut away.

The image reproduction system illustrated in FIG. 1 includes a dot matrix printer which is generally designated by reference numeral 10 and comprises two superimposed sets of electrically-insulated negative and positive band-like electrode members 12 and 14 disposed in parallel side-by-side relation, the negative electrode members 12 extending transversely of the positive electrode members 14 to define at their intersections a plurality of dot-forming matrix elements 16. Each negative electrode member 12 is electrically connected to a sweeping device 18 which is connected to the negative terminal of a direct current power supply 20 via a modulator 22 coupled to an electronic counter 24 operative to transmit electrical pulses to selected ones of the electrode members 12 during the sweeping thereof by the device 18. The modulator serves to vary the electrical pulses either in voltage or time. Each positive electrode member 14, on the other hand, is electrically connected to another sweeping device 18' which is connected to the positive terminal of the power supply 20. Thus, the electrodes of selected ones of the matrix elements 16 are electrically energized by sequentially energizing the positive electrode members 14 with the sweeping device 18' and concurrently sweeping the negative electrode members 12 with the device 18 while transmitting with the counter 24 electrical pulses to selected electrode members 12, which are modulated either in voltage or time by the modulator 22.

Figure 2:
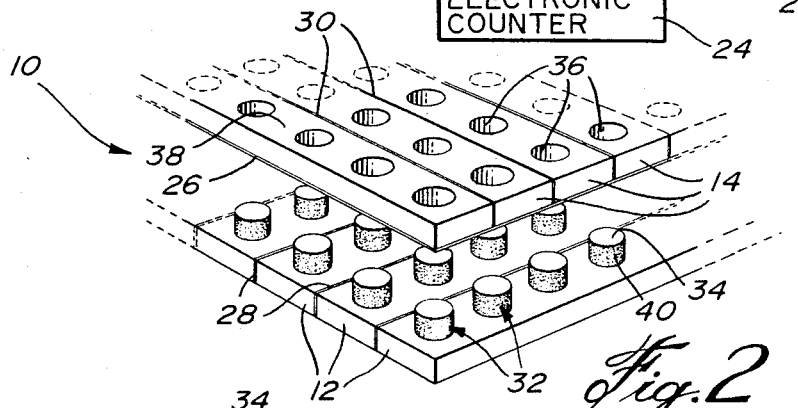
FIG. 2 is fragmentary exploded view of the dot matrix printer shown in FIG. 1.
Figure 3:
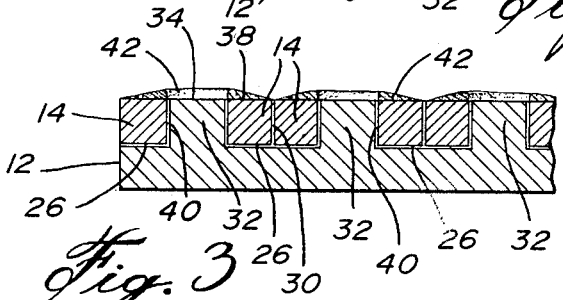
FIG. 3 is a sectional view taken along line 3—3 of FIG. 1.
Figure 4:
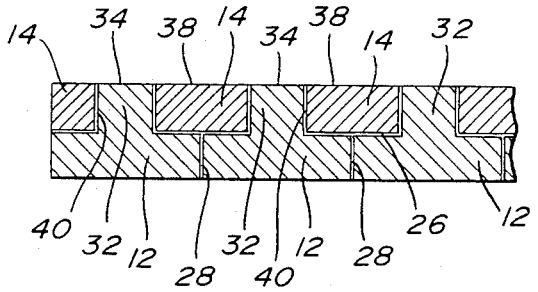
FIG. 4 is another sectional view taken along line 4—4 of FIG. 1.

As shown in FIGS. 2–4, the negative and positive electrode members are electrically insulated from one another by means of a layer of insulating material 26 having a thickness of about 10$\mu$. The negative electrode members 12 are also electrically insulated from one another by a layer of insulating material 28 having a thickness of about 25$\mu$. The positive electrode members 14 are similarly insulated by means of a layer of insulating material 30 having a thickness of about 10 to 25$\mu$, preferably 10$\mu$. Each negative electrode member 12 is formed with a plurality of protruding conductive elements 32 of circular cross-section which are spaced along the length thereof and each have a planar active end surface 34. The protruding elements 32 of each negative electrode 12 extend through corresponding bores 36 formed in the positive electrode members 14 to terminate flush therewith such that the planar active end surface 34 of each element 32 and a planar active surface portion 38 of a positive electrode member 14 adjacent a bore 36 extend in a common plane. Each protruding element 32 is of course electrically insulated from its adjacent positive electrode member 14 by means of a layer of insulating material 40 such as silicon monoxide, having a thickness of about 5 to 10$\mu$, preferably 10$\mu$.

Thus, the planar end surface 34 of each protruding element 32 and the planar surface portion 38 of each positive electrode member 14 adjacent each element 32 constitute the electrode active surfaces of each dot-forming matrix element 16. Each matrix element preferably has a square surface area of about $125\mu \times 125\mu$, protruding element 32 of each matrix element 16 being disposed centrally thereof and having a diameter of about 25 to $50\mu$; the elements 32 are therefore invisible to the naked eye. The dot matrix printer 10 comprises about 40,000 of such matrix elements 16 per square inch.

The negative electrode members 12 can be made of any metal, copper or stainless steel being preferred. However, the positive electrode members 14 must be made of a metal that will resist electrolytic attack and enhance electro-coagulation, such as stainless steel, aluminum, nickel, chromium or tin, these metals being electro-negative with respect to hydrogen. The surfaces 38 of the positive electrode members 14 are advantageously unpolished to enhance the adherence of the coagulated colloid thereon. The electrode members 14 can be produced by ion sputtering and can thus be as thin as $10\mu$.

In order to reproduce an image with the system just described, a layer of a liquid colloidal dispersion containing a colloid such as gelatin or albumin, water and an electrolyte such as potassium chloride, and having a substantially uniform temperature throughout the layer, is applied over the surface of the dot matrix printer 10. The sweeping devices 18 and 18' and the counter 24 are then activated so as to electrically energize the electrodes of selected ones of the matrix elements 16 and thereby cause selective coagulation and adherence of the colloid onto the positive electrode active surfaces 38 of the selected matrix elements, the coagulated colloid 42 forming a series of corresponding dots representative of the desired image.

The layers of insulating material 30 between the positive electrode members 14 should be as thin as possible so as to provide a continuous image and not one which is streaked. The layer of insulating material 40 surrounding each protruding element 32 should also be as thin as possible since the thinner the layer 40 the faster is the speed of electro-coagulation.

Figure 5:
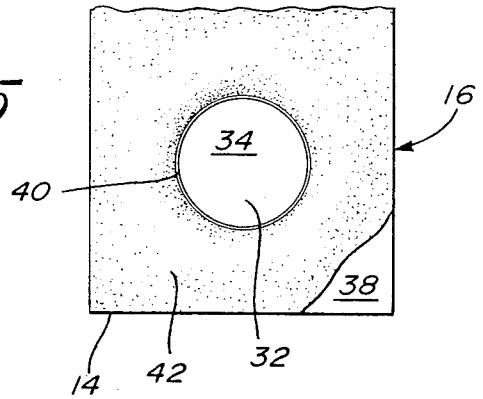
FIG. 5 is a top view of a matrix element of the dot matrix printer shown in FIG. 1.
Figure 6:
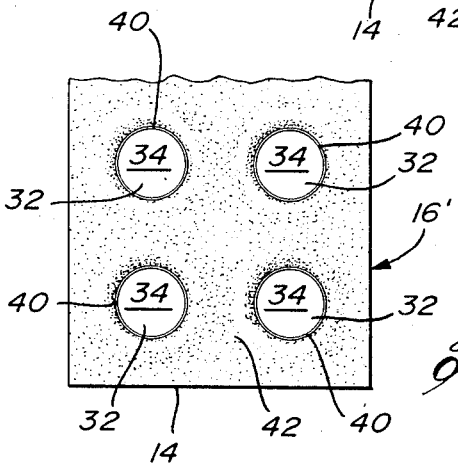
FIG. 6 is a view similar to FIG. 5 but showing a different type of matrix element.

Instead of having matrix elements 16 each formed with a single centrally disposed protruding element 32 as shown in FIG. 5, it is of course also possible to provide matrix elements 16' each formed with a plurality of spaced-apart elements 32 as represented in the embodiment illustrated in FIG. 6. Such an arrangement enables one to produce an image having a more uniform tone repartition.

With the image reproduction system described above, it has been observed that the power required to produce coagulation over a square surface area of about $125\mu \times 125\mu$ is the charge of an electrolytic capacitor of 2 micro farads at 50 volts. In other words, using a power generator of 25 watts (50 V, 500 mA), one can produce about 100,000 dots per second.

Although the dot matrix printer 10 has been illustrated as having a planar display surface, it is apparent that the whole surfaces of the positive electrode members 14 which constitute the display surface of the printer 10 need not be planar, provided however that the electrode active surfaces of each matrix element be planar and extend in a substantially common plane. Thus, for example, a cylindrical dot matrix printer could be designed in which each matrix element would have the required characteristic just mentioned.

I claim:

1. A method of reproducing an image by electro-coagulation of an electrolytically coagulable colloid, which comprises the steps of:

(a) providing a plurality of negative and positive electrolytically inert electrodes electrically insulated from one another and arranged to define a matrix of dot-forming elements, the negative and positive electrodes of each matrix element having respective planar active surfaces with the negative electrode active surface extending in substantially the same plane as the positive electrode active surface and in close proximity thereto;

(b) applying a layer of a substantially liquid colloidal dispersion over the negative and positive electrode active surfaces of the matrix elements whereby the positive and negative electrode active surfaces are disposed on the same side of the layer of colloidal dispersion, said colloidal dispersion containing an electrolytically coagulable colloid, a liquid dispersing medium and a soluble electrolyte and having a substantially uniform temperature throughout said layer;

(c) generating an electrical field between the negative and positive electrodes of selected ones of said matrix elements, said electrical field extending substantially parallel to the planar active surfaces of the negative and positive electrodes, whereby to cause selective coagulation and adherence of the colloid onto the positive electrode active surfaces of said selected matrix elements, thereby forming a series of corresponding dots representative of a desired image; and (d) removing any remaining non-coagulated colloid.

2. A method as claimed in claim 1, wherein the negative and positive electrodes of said matrix of dot-forming elements comprise respectively first and second sets of mutually electrically-insulated band-like electrode members disposed in parallel side-by-side relation, the negative electrode members of the first set extending transversely of the positive electrode members of the second set and being formed with a plurality of protruding conductive elements which are spaced along the length thereof and each have a planar active end surface, the protruding elements of each negative electrode member extending through corresponding bores formed in said positive electrode members to terminate flush therewith such that the planar active end surface of each protruding element and a planar active surface portion of each positive electrode member adjacent each said bore extend in a substantially common plane whereby to define said matrix elements, and wherein step (c) is effected by sequentially energizing the electrode members of one set and concurrently energizing selected ones of the electrode members of the other set.

3. A method as claimed in claim 2, wherein step (c) is carried out by sequentially energizing said positive electrode members and concurrently energizing selected ones of said negative electrode members.

4. A method as claimed in claim 2, wherein the concurrent selective energizing of the electrode members of the other set is effected by sweeping said electrode members and transmitting electrical pulses to selected ones thereof during sweeping.

5. A method as claimed in claim 4, wherein said electrical pulses are varied in voltage or time from one electrode member to another whereby to correspondingly vary the amount of coagulated colloid adhered onto the positive electrode active surfaces of said selected matrix elements.

6. A method as claimed in claim 1, further including the steps of coloring the coagulated colloid and transferring the colored coagulated colloid onto an end-use support.

7. A method as claimed in claim 1, further including the step of hardening the coagulated colloid whereby to use the hardened coagulated colloid for off-set lithographic printing.

8. A method as claimed in claim 1, wherein said colloid is a linear colloid having a molecular weight of about 10,000 to about 1,000,000.

9. A method as claimed in claim 8, wherein said colloid has a molecular weight comprised between about 100,000 and about 500,000.

10. A method as claimed in claim 8, wherein said colloid is selected from the group consisting of animal and vegetable proteins and synthetic copolymers.

11. A method as claimed in claim 8, wherein said colloid is an animal protein selected from the group consisting of albumin and gelatin, the dispersing medium is water and the electrolyte is selected from the group consisting of potassium chloride, sodium chloride, calcium chloride, nickel chloride, lithium chloride, ammonium chloride, copper chloride and manganese sulfate.

12. A method as claimed in claim 8, wherein said colloid is a synthetic copolymer selected from the group consisting of polyacrylic acid, polyacrylamide and polyvinyl alcohol.

13. A system for reproducing an image by electrocoagulation of an electrolytically coagulable colloid, which comprises:

a plurality of negative and positive electrolytically inert electrodes electrically insulated from one another and arranged to define a matrix of dot-forming elements, the negative and positive electrodes of each matrix element having respective planar active surfaces with the negative electrode active surface extending substantially in the same plane as the positive electrode active surface and in close proximity thereto, the electrode active surfaces being adapted to receive thereover a layer of a substantially liquid colloidal dispersion containing an electrolytically coagulable colloid, a liquid dispersing medium and a soluble electrolyte and having a substantially uniform temperature throughout said layer; and means for electrically energizing the negative and positive electrode of selected ones of the matrix elements to cause selective coagulation and adherence of the colloid onto the positive electrodde active surfaces of the selected matrix elements and to thereby form a series of corresponding dots representative of a desired image.

14. A system as claimed in claim 13, wherein the negative and positive electrodes of said matrix of dot-forming elements comprise respectively first and second sets of mutually electrically-insulated band-like electrode members disposed in parallel side-by-side relation, the negative electrode members of the first set extending transversely of the positive electrode members of the second set and being formed with a plurality of protruding conductive elements which are spaced along the length thereof and each have a planar active end surface, the protruding elements of each negative electrode member extending through corresponding bores formed in said positive electrode members to terminate flush therewith such that the planar active end surface of each protruding element and a planar active surface portion of each positive electrode member adjacent each said bore extend in a substantially common plane whereby to define said matrix elements, and wherein the electrical energizing means include means for sequentially energizing the electrode members of one set and means for concurrently energizing selected ones of the electrodes members of the other set.

15. A system as claimed in claim 14, wherein the sequential energizing means comprises a sweeping device connected to a positive terminal of a direct current power supply and adapted to sweep said positive electrode members, and wherein the selective energizing means comprises a further sweeping device connected to a negative terminal of the power supply for sweeping said negative electrode members and a counting device coupled to said further sweeping device for transmitting electrical pulses to selected ones of said negative electrode members during operation of the further coupling device.

16. A system as claimed in claim 15, further including modulating means for varying said electrical pulses in voltage or time from one negative electrode member to another whereby to correspondingly vary the amount of coagulated colloid adhered onto the positive electrode active surfaces of said selected matrix elements.

17. A system as claimed in claim 14, wherein each matrix element comprises a single protruding element disposed substantially centrally thereof.

18. A system as claimed in claim 17, wherein each matrix element has a square surface area of about $125\mu \times 125\mu$ and wherein said single protruding element is circular in cross-section and has a diameter of about 25 to $50\mu$.

19. A system as claimed in claim 14, wherein each matrix element comprises a plurality of protruding elements arranged in spaced-apart relation to provide an image having a uniform tone repartition.

20. A system as claimed in claim 14, wherein each protruding element is electrically insulated from its adjacent positive electrode member by means of a layer of insulating material having a thickness of about 5 to $10\mu$.

21. A system as claimed in claim 14, wherein said positive electrode members are electrically insulated from one another by means of a layer of insulating material having a thickness of about 10 to $25\mu$.

22. A system as claimed in claim 21, wherein said layer of insulating material has a thickness of about $10\mu$.

23. A system as claimed in claim 13, wherein said matrix of dot-forming elements comprises about 40,000 dot-forming matrix elements per square inch.

* * * * *

UNITED STATES PATENT AND TRADEMARK OFFICE

CERTIFICATE OF CORRECTION

PATENT NO. : 4,555,320

DATED : Nov. 26, 1985

INVENTOR(S) : Adrien CASTEGNIER

It is certified that error appears in the above-identified patent and that said Letters Patent is hereby corrected as shown below:

Column 2, line 11, kindly delete "by" and insert therefor -- thereby --.

Column 3, line 61, kindly delete "is" and insert therefor -- in --.

Signed and Sealed this

Fourth Day of November, 1986

[SEAL]

*Attest:*

DONALD J. QUIGG

*Attesting Officer*

*Commissioner of Patents and Trademarks*